United States Patent [19]

Lin

[11] Patent Number: 4,607,317

[45] Date of Patent: Aug. 19, 1986

[54] NON-NEON LIGHT

[76] Inventor: Ta-Yeh Lin, 2/F, 16 Central S. Rd., Sec. 2, Peitou, Taipei, Taiwan

[21] Appl. No.: 640,586

[22] Filed: Aug. 14, 1984

[51] Int. Cl.[4] ..... F21V 29/00

[52] U.S. Cl. ..... 362/249; 362/122; 362/124; 362/216; 362/219; 362/223; 362/224; 362/225; 362/250; 362/252; 362/287; 362/311; 362/320; 362/355; 362/362; 362/806

[58] Field of Search ..... 362/285, 287, 249, 250, 362/252, 319, 320, 311, 351, 355, 362, 806, 216, 219, 223, 224, 225, 122, 124

[56] References Cited

U.S. PATENT DOCUMENTS

| | | | |
|---|---|---|---|
| 4,107,767 | 8/1978 | Anquetin | 362/252 |
| 4,177,503 | 12/1979 | Anquetin | 362/252 |
| 4,439,818 | 3/1984 | Scheib | 362/250 |

*Primary Examiner*—Stephen J. Lechert, Jr.
*Attorney, Agent, or Firm*—Holman & Stern

[57] ABSTRACT

This invention is related to a "non-neon light" which may be directly, manually and freely bent and folded for linear and arched installation for any suitably prepared advertising decoration or similar lamp ornament in a plane figure or dimensional formative article in optional line with the fondness and purpose of installer or user, and consists of a bendable and foldable bulb-holding bar and a set of connecting device wherein the bendable and foldable bulb-holding bar comprises a main bulb-holding bar body made of soft or semi-soft PVC or similar plastic through drawing by a molding/extruding machine, each one electric wire with a suitable number of ply on the left and right sides of this bar, and each one corresponding fillister with a suitable depth and width on the upper and lower sides thereof, a plurality of conductive plugs connected with several or a plurality of small bulbs spaced with suitable pitch in series, and the foremost and terminal bulbs of each set of small bulbs connected with the two electric wires in parallel, and a superficial lamina with a suitable thickness made of a soft or semi-soft PVC or similar plastic by a molding/extruding machine to cover the circumferential outer wall of the foregoing main bulb-holding bar body; the connecting device comprises a connecting plug and a connecting socket respectively inserted in and screwed on each connecting end of said two bendable and foldable bulb holding bar bodies to be mutually connected in favor of optional removal, disassembly and segmentation for installation, packing and shipping quickly and safely; and the said bar body is characterized by resistance to pressure and no breach and damage during installation packing and shipping and capable of saving energy.

6 Claims, 8 Drawing Figures

NON-NEON LIGHT

BRIEF SUMMARY OF THE INVENTION

This invention is related to a "non-neon light" which may be directly, manually and freely bent and folded for linear or arched installation for any suitably prepared advertisement, decoration or similar lamp ornament in a plane figure or dimensional formative article in optional line with the fondness and purpose of installer or user. The object of this invention is to offer an improved light which is characterized by waterproofness, resistance to pressure, optional cutoff for the desirable length required for installation and use; considerably quick, safe and easy installation; convenient handling, transportation, portability, connection and assembly or removal and disassembly without breach and damage during installation and use; and saving energy.

DETAILED DESCRIPTION

The conventional neon tube is a small and extremely thin glass tube which has to be folded into the scheduled shape before installation, and the folding and formative work has to rely on somebody who has learned it or completed the professional training concerned so as to achieve the practical bending, folding, manufacturing and installing operations of neon advertising and decorative lamps. In other words, these operations cannot be done by the people at large who are familiar with the electric art. Particularly, the said conventional neon tube requires an a.c. power supply over 1200 V–1500 V voltage in order to light it. Therefore, the absolute insulation has to be particularly emphasized during its installation so as to avoid leakage or short. Meantime, special care should be taken during its handling, shipping or use, otherwise a trifling carelessness will easily cause its breach and damage, so it is extremely inconvenient to install and use the conventional neon tube and considerably easy to cause its prohibitive loss, and it wastes a lot of energy. As a matter of fact, it is not an ideal neon tube for advertising or decorative lamps.

In view of the foregoing drawbacks of conventional neon tube, this inventor, through his repeated research, trial manufacture and experimental use, has invented a "non-neon light" which is characterized by simple construction, easy manufacture, assured waterproofness, resistance to pressure, unbrokenness, optionally bending and folding into linear or arched installation with rapidity, safety and convenience; convenient handling, transportation, portability, connection and assembly or removal and disassembly without breach and damage during installation and use, and saving energy.

Figure 1:
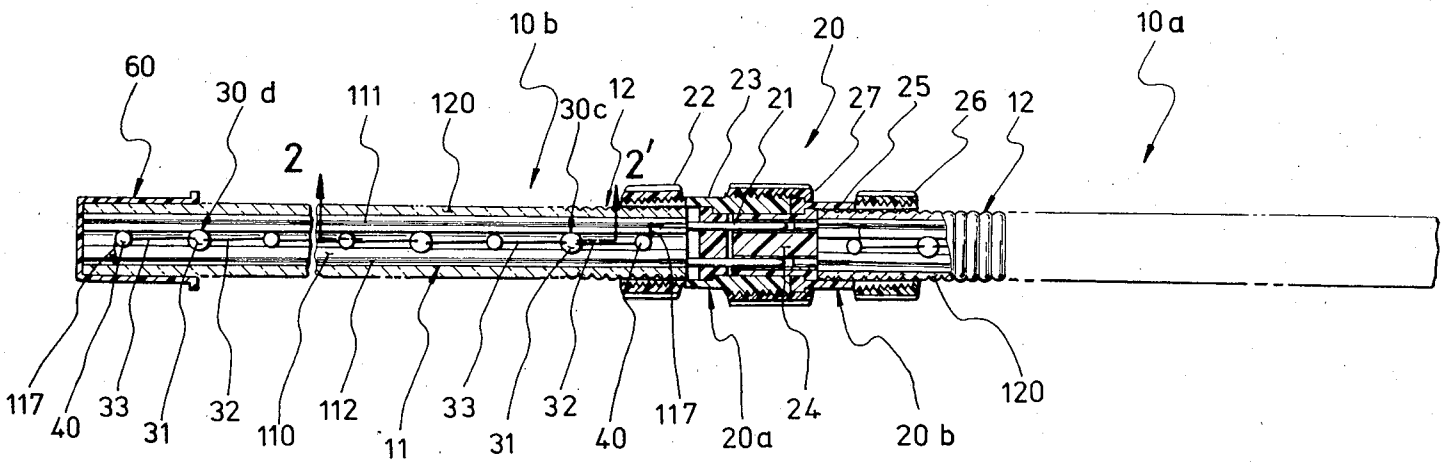
FIG. 1 is a longitudinal sectional view of this invention.
Figure 2:
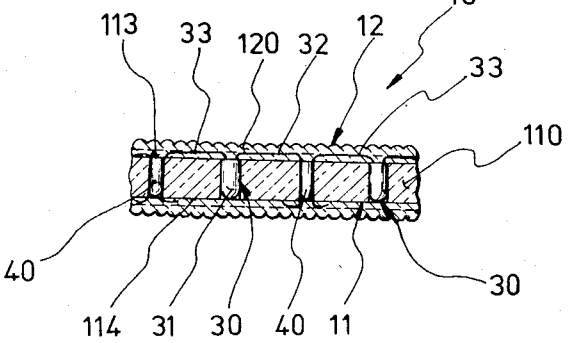
FIG. 2 is a partial section view on line 2—2' of FIG. 1.
Figure 3:
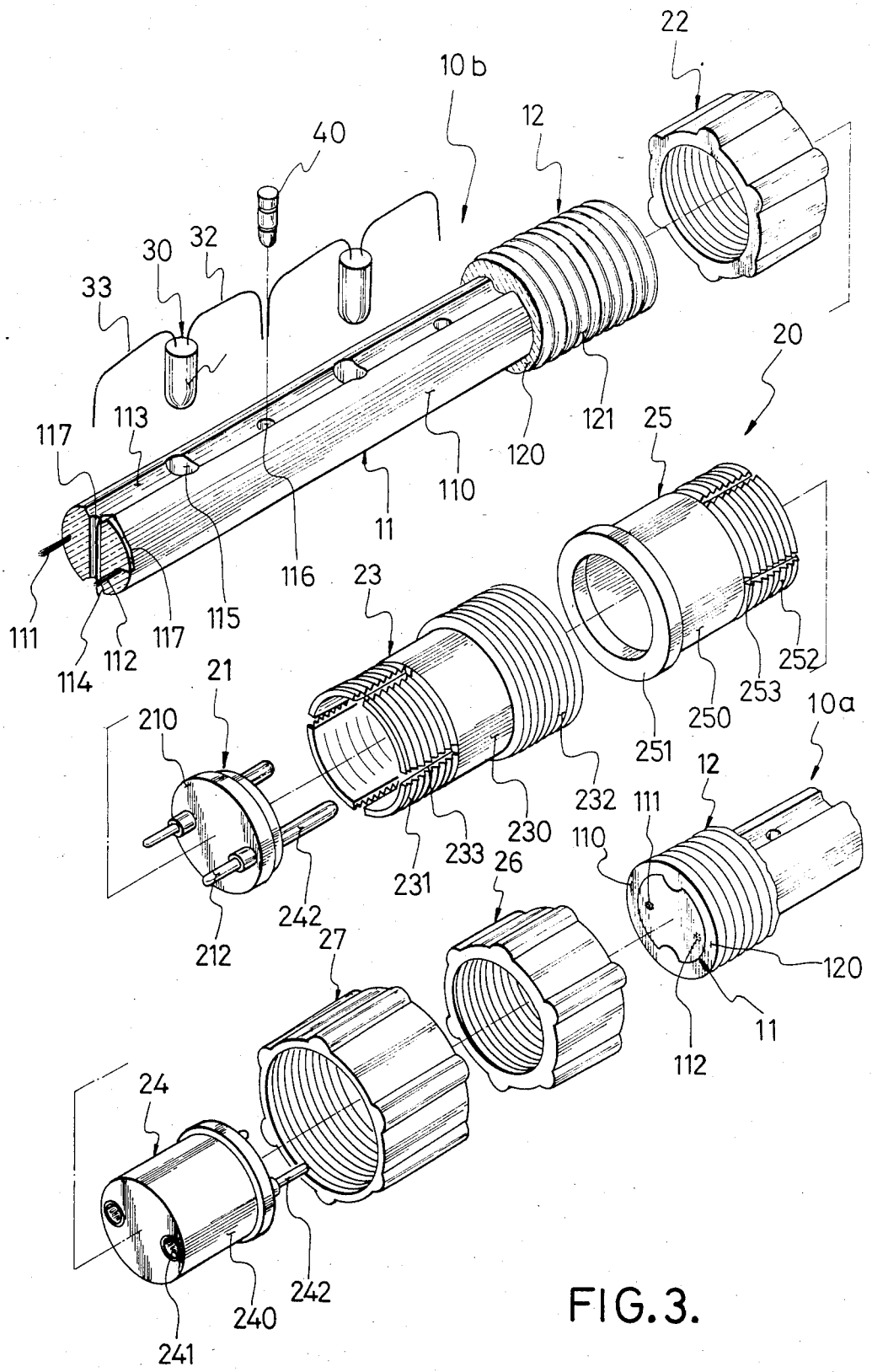
FIG. 3 is a dimensional disassembly systematic view of various components of this invention.

This invention can be best understood by reference to the examples which are described in detail hereinafter:

As shown in FIGS. 1 and 2, this invention mainly consists of a bendable and foldable bar 10 for holding bulbs and a set of connecting devices 20 wherein the bendable and foldable bar 10 for holding bulbs, as shown in FIG. 3, mainly is comprised of a main bar 11 for holding bulbs, of which the circumferential outer wall is covered with a superficial lamina or sleeve 12 of soft or semi-soft PVC or similar plastic with a suitable thickness by a molding/extruding machine; the main bar 11 for holding bulb mainly consits of a main bar body 110 for holding bulb, which is made of a transparent or semi-transparent soft PVC or similar plastic by a molding/drawing machine, and comprised of two electric wires 111, 112 with suitable number of ply on left and right sides and two corresponding fillisters or grooves 113, 114 with suitable depth and width on upper and lower sides. Penetrative or non-penetrative large holes 115 and penetrative or non-penetrative small holes 116 spaced with a suitable pitch between the corresponding fillisters 113,114 are designed to reversely insert a small bulb 30 into the large hole 115 and a conductive plug 40 into the small hole 116 for connection in series with each set of small bulb 30 or further connection in parallel with the two electric wires 111, 112 preset in the main bar 110 for holding bulb.

Figure 5:
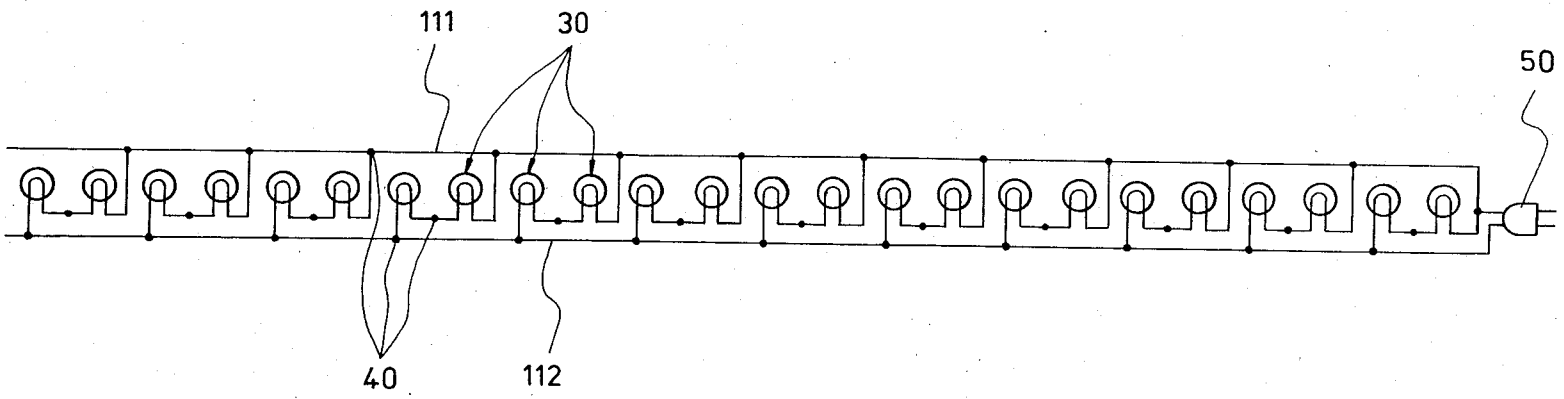
FIG. 5 is an optional view of an example of a small bulb installing scheme of wiring applied to 12 V voltage adopted by this invention.
Figure 6:
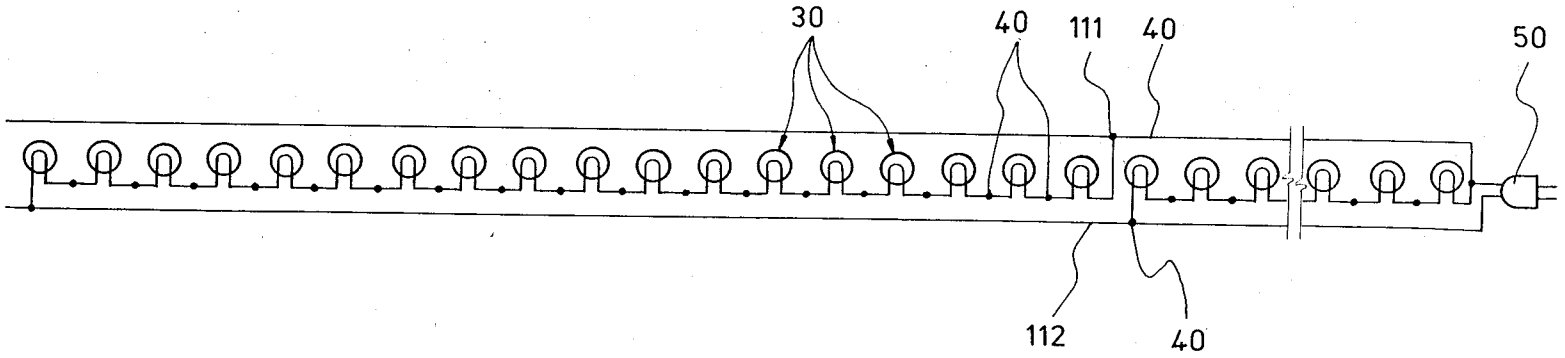
FIG. 6 is an optional view of an example of a small bulb installing scheme of wiring applied to 110 V voltage adopted by this invention.

As shown in FIG. 3, the small bulb 30 is comprised of a bulb body 31 similar to a LED small bulb, and two conductive wires 32, 33 made of copper or other metal with good conductivity extended from the lower side of bulb 30. These two conductive wires 32, 33 are respectively folded toward left and right, flat placed in the upper fillister 113 (or lower fillister 114) on the main bar body 110 for holding bulb and then inserted into the penetrative or non-penetrative small hole 116 wherein a conductive plug 40 made of copper or other metal with good conductivity is also inserted so as to fix the conductive wires 32, 33 (as shown in FIG. 2) in favor of connecting a set of two, four, eighteen or thirty-six small bulbs 30 in series so that this invention may be applied to the current with different voltage. Each small bulb 30 is specially applied to the current with 6 V voltage but the voltage value of current in general is divided into 12 V, 24 V, 110 V and 220 V, so connecting every two, four, eighteen and thirty-six small bulbs 30 in series as a set and then in parallel with the two electrical wires 111, 112 may be directly and respectively plugged in the power source socket with the foregoing different voltage value for use without transformation in advance. The examples of connection in parallel applied to the 12 V and 110 V current are respectively shown in FIGS. 5 and 6. Only connecting every two or eighteen small bulbs 30 in series as a set and then in parallel with the two electric wires 111, 112 and installing a source plug 50 on one end of the two electric wires 111, 112 may be directly plugged in the socket with 12 V and 110 V current for use.

As shown in FIGS. 2 and 3, the penetrative or non-penetrative large and small holes 115, 116 spaced with a suitable pitch between the upper and lower fillisters 113, 114 on the main bar body 110 for holding bulb are drilled with a dual-axis or multi-axis automatic borer.

Each small bulb 30 is inserted into a large hole 115, the rear conductive wire 33 of each former small bulb 30*a* and the front conductive wire 32 of each latter small bulb 30*b* are folded and inserted in a small hole 116 between every two small bulbs 30*a*, 30*b*, and a conductive plug 40 made of copper or other metal with good conductivity is also inserted in the small hole 116 for connection in series with each set of small bulbs 30. After each set of small bulbs 30 is connected in series, at least a ply or several plies of conductive wire 117 for connection in parallel (as shown in FIGS. 1 and 3) are taken out from either one electric wire 113 or 112 in the corresponding positions of the foremost small bulb 30*c* and the last small bulb 30*d* (as shown in FIG. 1) on the main bar body 110 for holding bulb in favor of being inserted in the small hole 116 wherein a conductive plug 40 is inserted so that each set of small bulbs in parallel may connect with the two electric wires 111, 112 in favor of covering a superficial lamina 12 on the circumferential outer wall of main bar 11 for holding bulb. In favor of taking out a segment of specific conductive wire 117 with suitable length from the main bar body 110 for connection in parallel by means of an automatic wire-cutting machine or pliers, before drawing and molding the main bar body 110 and wrapping the two electric wires 111, 112 therein, the specific conductive wire 117 for connection in parallel to be taken out from the two electric wires 111,112 is marked with coloring or plating (such as silver or chrome) in favor of easily taking out it but never affecting the performance and function of the two electric wires 111, 112. The convex and concave lines on the superficial lamina 12 may be in the shape of thread 121 (as shown in FIG. 3) and guilloche, stripe and diamond or other suitable shapes, and the outer shape of bulb-holding bar 10 may be rounded as shown in the example and other optional shape such as oval, square, triangular, rhombic, polygonal and spiral. Meantime, the superficial lamina 12 or main bulb-holding bar body 110 may be made into colorless and transparent or colored and semi-transparent. In addition, the connection of small bulbs 30 in series and two electric wires 111, 112 in parallel on the main bulb-holding bar body 110 is achieved by means of firmly inserting the conductive plug 40, so this connection is very reliable and its conductivity is excellent.

The small bulbs 30 in the bendable and foldable bulb-holding bar 10 of this invention are installed set by set, so during the manufacture thereof, a suitable mark may be made at the middle between each two sets of small bulbs 30 in favor of cutting this bar 10 into the unified specifications such as 10 M, 20 M or 30 M and other optionally suitable shorter or longer length for production, processing and installation. Meantime, if it is too long, it may be cut into shorter length, all to do is to install a soft or semi-soft plastic or rubber protective cylinder 60 at the terminal end of bendable and foldable bulb-holding bar 10 (as shown in FIG. 1).

Figure 4:
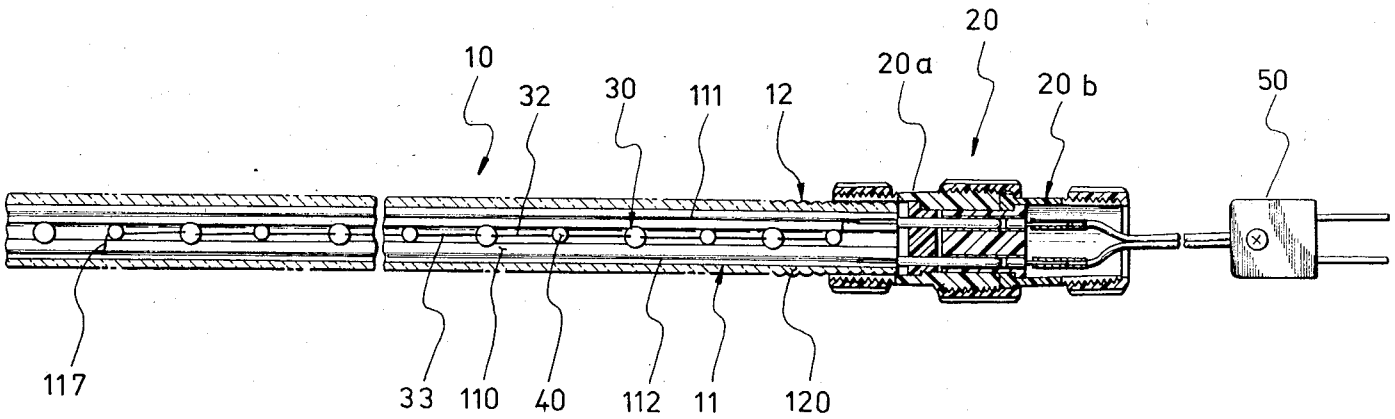
FIG. 4 is a longitudinal sectional view of an example of an installing plug of this invention.

During installation and use of this invention, if it is not long enough or has to be divided into different colors for connection, a set of connecting device 20 is designed to meet this requirement in favor of optional connection, disassembly or segmentation, or a plug 50 is installed in favor of connecting to a power source. This set of connecting device 20 as shown in FIGS. 1 and 3 mainly consists of a connecting plug 20*a* and a connecting socket 20*b* wherein the connecting plug 20*a* is composed of a plug 21, a nut 22 and a connecting cylinder 23. The plug 21 consists of a disc body 210 whereon two conductive inserting bars 211 with inserting pin 212 are fixed, and the connecting cylinder 23 consists of a cylinder body 230, a large threaded cylinder 232 and an obliquely threaded cylinder 231 with several notches 233 on the wall of cylinder. The two inserting pins 212 on the plug 21 are inserted in the two electric wires 111, 112 at the terminal of main bulb-holding bar body 110, and the nut 22 and the connecting cylinder 23 are assembled at the end of bendable and foldable bulb-holding bar 10*b*, then the nut 22 is used to tightly screw the connecting cylinder 23 at the said end where a connecting plug 20*a* is thus available for connecting the connecting socket 20*b* on another bulb-holding bar 10*a*. The connecting socket 20*b* consists of a socket 24, a connecting cylinder 25, a large nut 27 and a small nut 26. The socket 24 consists of a cylinder body 240 whereon two conductive inserting cylinders 241 with inserting pin 242 are fixed, and the connecting cylinder 25 consists of a snap ring 251 and an obliquely threaded cylinder 252 with several notches 253 on the cylinder wall at the two ends of cylinder body 250. The two inserting pins 242 on the socket 24 are inserted in the two electric wires 111, 112 at the terminal of main bulb-holding bar body 110, the large nut 27 is placed on the inner side of snap ring 251 of the connecting cylinder 25, the small nut 26 and the connecting cylinder 25 are placed at the end of bendable and foldable bulb-holding bar 10*a*, and the small nut 26 is used to tightly screw the connecting cylinder 25 at the end of bendable and foldable bulb-holding bar 10*a* where a connecting socket 20*b* is therefore available for connecting another bulb-holding bar 10*b*. When connecting the two bendable and foldable bulb-holding bars 10*a*, 10*b*, all to do is to insert the connecting plub 20*a* on one bulb-holding bar 10*b* in the socket 20*b* on another bulb-holding bar 10*a*, to use the large nut 27 on the connecting socket 20*b* to tightly screw the large threaded cylinder 232 on the connecting cylinder 23 on the connecting plug 20*a*, then the two bendable and foldable bulb-holding bar 10*a*, 10*b* are connected to each other as a whole bar and installed and used as a single bar. When a power source plug 50 is installed at the foremost end of bendable and foldable bulb-holding bar 10 (as shown in FIG. 4), a connecting device 20 mentioned above may be installed in favor of installing and removing the plug 50. In order to prevent the connecting plug 20*a* and connecting socket 20*b* mounted on one or two ends of each bendable and foldable bulb-holding bar 10 from damage during packing, handling and shipping before mutual connection, a protective cylinder with larger diameter or length than that of the protective cylinder 60 for the abovesaid bulb-holding bar 10 to be made of the material same as or similar to that thereof may be designed to encase the connecting plug 20*a* and connecting socket 20*b*, and removed and thrown away when use.

Figure 7:
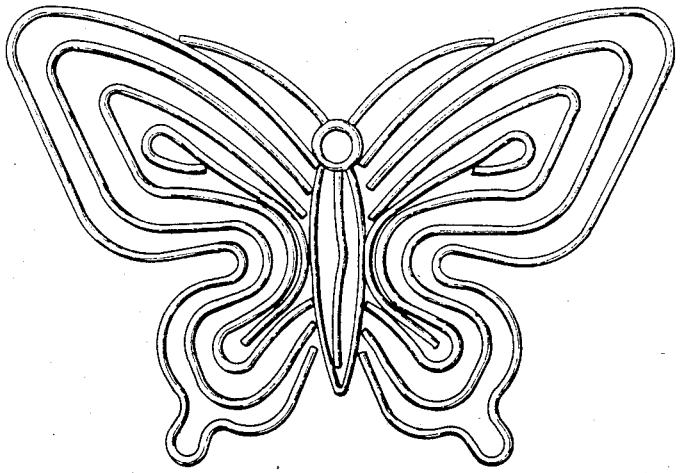
FIGS. 7 and 8 are optional views of exemplary plane figure and dimensional formative flower for practical installation and use of this invention respectively.
Figure 8:
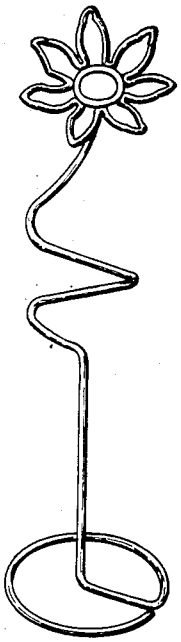

Since the bendable and foldable bulb-holding bar 10 of this invention "non-neon light" may be freely, optionally and manually bent and folded in line with the favorite shape and purpose of installer and user, and a set of connecting device 20 is available in keeping with installation, so it may be bent, connected and bound into the advertising and lamp decoration in a plane figure of butterfly through the dog spikes same as or similar to those for fixing telephone cord and cable as shown in FIG. 7 wherein the formative design is novel, unique, colorful and beautiful. Meantime, in keeping with the accessories such as supports and tying threads, a dimensional flower or formative ornament of other articles may be achieved as shown in FIG. 8, it is particularly grand and spectacular.

What I claim:

1. A flexible light strip comprising an elongate body member of flexible plastic, spaced electric wires extending longitudinally along opposite sides of the body member, at least one elongate surface groove extending the length of the body member between the wires, a series of spaced transverse holes formed in the body member from the base of the groove, light bulbs in alternate ones of said holes, the light bulbs each having a base portion with a pair of wires extending therefrom, conductive plugs in the remaining ones of said holes between the successive bulbs for electrically connecting the wires from adjacent bulbs, the wires from selected bulbs further being connectible to the longitudinally extending wires for connecting the bulbs to the longitudinally extending wires selectively in series or in parallel bulb groups, connector means for at least one end of the body member for connecting the body member mechanically and electrically endwise to another like strip or to a source of electric power, and an elongate tubular sheath of flexible plastic for encasing the body member light bulbs and plugs.

2. The invention of claim 1, wherein the connector means comprises pin and socket-type connector means for electrically connecting ends of the respective longitudinally extending wires of the body member to like longitudinally extending wires of a like strip or source of electricity, and threaded male and female connectors receiving the pin and socket-type connector means for mechanically connecting the body member to the like strip or source of electricity.

3. The invention of claim 1, wherein the alternating ones of said holes are of larger cross section than the remaining ones of said holes, and the light bulbs are of correspondingly larger cross section than the conductive plugs.

4. The invention of claim 1, wherein the light strip is connected end to end with another like strip for bending of the strips longitudinally to form an elongate light of selected shape.

5. The invention of claim 1, including a blind end cap for the other end of the body member.

6. The invention of claim 1 wherein the body member is of substantially circular cross section solid plastic with another elongate surface groove formed opposite the aforesaid surface groove, and wherein said holes extend between the grooves.

* * * * *